US008628186B2

(12) United States Patent
Schmalz

(10) Patent No.: US 8,628,186 B2
(45) Date of Patent: Jan. 14, 2014

(54) METHOD AND DEVICE FOR MONITORING NEGATIVE PRESSURE LOSS IN A NEGATIVE PRESSURE GENERATING DEVICE

(75) Inventor: Kurt Schmalz, Dornstetten (DE)

(73) Assignee: J. Schmalz GmbH, Glatten (DE)

( * ) Notice: Subject to any disclaimer, the term of this patent is extended or adjusted under 35 U.S.C. 154(b) by 855 days.

(21) Appl. No.: 12/834,027

(22) Filed: Jul. 12, 2010

(65) Prior Publication Data

US 2010/0277331 A1 Nov. 4, 2010

Related U.S. Application Data

(63) Continuation of application No. 11/630,348, filed as application No. PCT/EP2005/003504 on Apr. 4, 2005.

(51) Int. Cl.
*B41J 2/165* (2006.01)

(52) U.S. Cl.
USPC ..... 347/101

(58) Field of Classification Search
None
See application file for complete search history.

(56) References Cited

U.S. PATENT DOCUMENTS 6,416,295 B1 7/2002 Nagai

FOREIGN PATENT DOCUMENTS

| | | |
|---|---|---|
| JP | 5-71500 | 3/1993 |
| JP | 5-71662 | 3/1993 |
| JP | 9-317641 | 12/1997 |

*Primary Examiner* — Matthew Luu
*Assistant Examiner* — Alejandro Valencia
(74) *Attorney, Agent, or Firm* — Paul Vincent

(57) ABSTRACT

A device for generating an negative pressure comprises a plurality of ejectors and a receiving device therefor. The receiving device comprises at least one connection for a compressed air line, the connection protruding into a compressed air distribution system to which a compressed air channel of each ejector can be connected, and each ejector being provided with an negative pressure channel that can be connected to the negative pressure system of the ejector. The receiving device forms a holding frame and a quick-change system for the ejectors, and can be connected to the ejectors by means of control lines, and to a machine control system.

24 Claims, 3 Drawing Sheets

METHOD AND DEVICE FOR MONITORING NEGATIVE PRESSURE LOSS IN A NEGATIVE PRESSURE GENERATING DEVICE

This application is a continuation of Ser. No. 11/630,348 filed Dec. 21, 2006 as the national stage of PCT/EP2005/003504 filed on Apr. 4, 2005 and also claims Paris Convention priority of DE 10 2004 031 924.3 filed on Jun. 23, 2004, the entire enclosures of which are hereby incorporated by reference.

BACKGROUND OF THE INVENTION

The invention concerns a method and device for monitoring negative pressure loss in a negative pressure generating device, in particular an ejector.

There are a plurality of conventional ejectors, which are generally used to generate an negative pressure using compressed air. Ejectors are highly advantageous in that they can be connected to the generally existing compressed air network and therefore require no negative pressure lines. The ejectors are supplied with compressed air and generate the negative pressure in accordance with the Venturi principle. They are generally located directly in that area where the negative pressure is required. For this reason, long negative pressure channels needing permanent evacuation are not required, since an negative pressure can be immediately provided using ejectors.

There are conventional negative pressure gripping devices comprising several grippers which are independent of each other, each of which must be supplied with an negative pressure. This requires a corresponding number of ejectors. The compressed air lines must be guided to these ejectors and the negative pressure channels must be connected to the suction grippers. This is often difficult and can be realized only with a plurality of air tubes. When replacing an ejector for maintenance and/or repair, the tubing must generally be released and the electric connections be disconnected before the ejector can be removed from the connection.

DE-T-692 29 120 discloses a receiving device for an ejector having a centralized pressurized air supply. DE-U-201 20 609 discloses an ejector having an analysis device for determining wear by measuring working cycles. The number of working cycles can, however, only provide an empirical indication of possible wear. The actual wear could lead to a substantially earlier or later failure. Moreover, the state of components outside of the ejector, such as feed and exhaust lines, cannot be monitored.

It is the underlying purpose of the invention to provide a device with a simpler design and with which defects can be more easily determined.

SUMMARY OF THE INVENTION

This object is achieved with a device structured to execute a method for monitoring loss of negative pressure in a device generating negative pressure for suctioning and handling work pieces, the method comprising the steps of:

a) determining a number of suctioned and handled work pieces;
b) defining a reference number of operating cycles to be equal to the number of suctioned and handled work pieces;
c) measuring and counting an actual number of operating cycles;
d) comparing the actual number of operating cycles to the reference value of operating cycles; and e) determining a degree of negative pressure loss in the device in dependence on a difference between the actual number of operating cycles and the reference number of operating cycles.

During normal operation of a device generating negative pressure for suctioning and handling work pieces, the device suctions and blows-off a given number of work pieces per unit time. If the system is substantially leak tight, one evacuation and blow-off cycle is required for each work piece. However, should the system suffer leakage due to wear or for other reasons, the required negative pressure for suctioning and handling a given work piece will not be maintained during a working cycle. This vacuum leak will be detected by the device and an additional evacuation cycle will be initiated. Therefore, if the system performs properly, the number of operation cycles for evacuation is equal to the number of suctioned and handled work pieces. If the system leaks, then the number of evacuation cycles exceeds the number of suctioned and handled work pieces. Accordingly, a comparison between the number of evacuation cycles with the number of suctioned and handled work pieces provides an indication of the extent of negative pressure loss.

The regulation processes of the ejector are e.g. switching on and off the bi-stable valve in the compressed air channel in dependence on the presence or the level of the negative pressure. The control processes are e.g. used to detect the frequency, speed and rate compared to normal, of adjustment of the negative pressure to the desired value. It also determines whether error messages are of the same type, i.e. whether the same errors occur all the time. In this case, the monitoring means cause the regulation to be switched off for reasons of safety and a permanent negative pressure is generated. In this case, a machine operator must deliberately switch to "reset" either via the machine control unit, on the ejector or wireless. The limit parameters that define such an error can be set or are fixed.

Towards this end, a receiving device for a plurality of ejectors can be provided having at least one connection for a compressed air conduit, with this connection feeding into a compressed air distribution system to which a pressurized air channel of each ejector can be connected, with each ejector having an negative pressure channel which can be connected to the negative pressure system of the ejector, wherein the receiving device constitutes a holding frame and a rapid-connection system for the ejectors, the receiving device being connected to the ejectors via control lines and can be connected to a machine control unit. The receiving device is charged with the ejectors. In order to supply compressed air to the ejectors, the receiving device has a compressed air distribution system to which the compressed air channels of the individual ejectors are connected. This is highly advantageous since each individual ejector must not be connected to a compressed air tube, but merely one connection is required via which the compressed air distribution system of the receiving device is provided with compressed air. This eliminates a plurality of tubes, in particular, in large systems with 6 or 12 ejectors, and the ejectors can be disposed closer together in a more orderly fashion.

The receiving device may have a holding frame into which the ejectors are inserted and reliably held. The gripping device itself must no longer be structured for holding the ejectors, which could be very complex, since the ejectors must be fixed and also disposed such that the compressed air and negative pressure tubes are not bent. In the inventive device, only the receiving device is mounted to the gripping device, using conventional fastening means e.g. screws or clamping devices. The holding frame advantageously has plug couplings for voltage supply and data lines via which the ejector is supplied with energy, and via which data is input into data processing means in the ejector, wherein data can be read-out from the ejector. In this fashion, the ejector can be connected e.g. to a machine control unit in a fast, simple and also reliable fashion.

The receiving device also has a fast-exchange system for the ejectors, such that they can be inserted and removed from the receiving device, preferably without using a tool.

In a further development of the invention, the ejector has a bi-stable valve for blocking the compressed air channel. The supply of compressed air into the ejector can be switched on and off via this bi-stable valve. In this fashion, vacuum generation is switched on or off in a defined fashion.

In a first variant of the invention, the bi-stable valve may be driven via a command of the machine control unit which is the case e.g. when it is determined that no workpiece was suctioned, since the gripper is not occupied. The machine control unit generally knows the shape of the workpiece and which grippers must be activated in order to suction the workpiece. The inactive grippers, i.e. the grippers which do not abut the workpiece, do not suction air, thereby preventing unnecessary noise and consumption of energy. In a second variant, the bi-stable valve is driven via a command of a sensor contained in the ejector, wherein the sensor detects e.g. the level of negative pressure and the negative pressure generation is switched off by closing the bi-stable valve when the desired negative pressure has been reached. This is the case, when the workpiece has been completely suctioned by the respective gripper. This saves compressed air.

In a further development of the invention, the valve is designed as a self-holding valve, such that it maintains its instantaneous position when the voltage drops. When no workpiece has been suctioned, the valve remains in its closing position, whereas the valve of a suction gripper with suctioned workpiece remains in the open position, or when the required negative pressure has been reached and the valve has assumed its closing position, the valve changes into the open position in order to ensure that the workpiece does not fall down or the negative pressure on the workpiece does not collapse.

The valve is preferably a series valve which can be controlled via part of the air flow required for an air control valve. The negative pressure is generated using the residual air flow, wherein the smaller partial air flow is required to actuate the bi-stable series valve.

In accordance with the invention, the ejector has a second monitoring means for detecting the evacuation time. An ejector usually requires e.g. 200 ms in order to build up the required negative pressure. When this evacuation time is exceeded by a predetermined amount, an error message is issued. The predetermined evacuation time is e.g. exceeded due to leakage in the negative pressure line or in the seal between the suction gripper and the workpiece, due to clogging of the flow paths, in case of porous workpieces, insufficient compressed air etc. Further sensors may advantageously be provided in order to better define the error message. A pressure sensor for compressed air may e.g. determine whether it has the required pressure.

In accordance with a preferred embodiment, a control means is provided which drives the ejector when the suction process is terminated and adjusts the ejector from the suction state to the blow-off state. The duration of blowing off is thereby fixed.

In a variant of the invention, the blow-off time may also be adjusted or be variable. In a first embodiment, the machine control unit has priority and determines the adjustment point to the blow-off process after suctioning, i.e. determines the break or delay between the suctioning process and blow-off process. Moreover, the machine control unit determines the blow-off time and/or the blow-off pressure.

In a further embodiment of the variant, these values are predetermined by the machine control unit, but the ejector has priority. It is thereby possible to adjust the duration of the blow-off process on the ejector, wherein this value is superposed on the control command of the machine control unit. The priorities of the devices can be adjusted on the ejector.

In a further development of the invention, the ejector has a counter for counting the number of suctioned workpieces, the number of valve position changes, the number of regulation errors and/or the like. This information can be used e.g. to determine the maintenance intervals. Moreover, one can check whether or not the number of actual operating cycles corresponds to the number of suctioned and handled workpieces. These counting processes are not only valid for the suctioning process but also for the blow-off process. The quality of the workpieces, the vacuum suctioning device, the feed and discharge lines, and of the machine control unit itself and even of the ejector can be evaluated through the number of regulation errors.

Data determined in the evaluation means is transmitted e.g. via a transmission means to the machine control unit. This may be effected in real time, or a memory may be provided in the ejector for storing the detected data. The data is read-out from this memory at predetermined times. In accordance with the invention, reading-out is also possible in a wireless fashion.

In an inventive variant, the ejector has a self-diagnosis means via which the quality of the ejector can be determined and malfunctions can be avoided. It is e.g. possible to determine certain tendencies and thereby detect e.g. that the evacuation time is permanently extended, that one or more valve(s) switch more frequently and the like.

The self-diagnosis means is thereby provided with a valve that closes the suction channel. When the suction channel is closed for self-diagnosis, the evacuation time can e.g. be determined and compared to reference values. This also applies for the maximum negative pressure that can be obtained.

In accordance with a preferred further embodiment, the ejector has an evaluation means for the signals detected by the sensors of the ejector. This evaluation means is independent of the machine control unit or the evaluation means of the machine control unit, such that all signals detected by the sensors of the ejector are evaluated directly in the ejector, wherein the ejector is independent of the machine control unit. This has the substantial advantage that the ejector may be universally used and the machine control unit need not be adjusted to the ejector. Retrofitting of machines is thereby substantially facilitated.

In a particularly preferred embodiment of an ejector, the ejector comprises a display which can be dimmed or switched off. Since the display is required only for adjustments or for reading values, the display is dimmed or switched off at any other time. This can be effected either manually or automatically, wherein the display automatically reduces the luminance or switches off after expiry of a time period which can, in particular, be predetermined.

The display may either be an analog display or a digital display, wherein the illumination and also the display element itself of the analog displays return to the rest position, when the display is not required. The display can, in particular, be switched on manually and/or by the machine control unit, and automatically switches off in case of an error message.

Switched-on displays therefore signal a state which differs from the normal state such that the corresponding ejectors with switched-on displays can be quickly traced.

A further distinctive visual feature is that the display is multi-colored. A value above a limit value may e.g. be displayed in red and all values within a desired range may be green. A red display signals an error in a simple fashion. The value itself may be displayed in red or the display has an additional red lamp. A further visual feature may be a flashing diode which flashes quickly or slowly depending on the importance or urgency of the information to be transmitted.

In accordance with the invention, the display is disposed along an edge of the ejector in order to read or see it from a remote position or large viewing angle. In accordance with the invention, the display projects past the surface of the ejector. In this fashion, a viewing angle of more than 270° is effected. This display consists of e.g. a light diode that is provided in the edge, projects past the surface of the ejector, and changes, in particular, from green to red.

Further advantages, features and details of the invention can be extracted from the dependent claims and the following description which describes in more detail a particularly preferred embodiment with reference to the drawing. The features shown in the drawing and mentioned in the description and the claims may thereby be essential to the invention either individually or collectively in arbitrary combination.

DESCRIPTION OF THE PREFERRED EMBODIMENT

Figure 1:
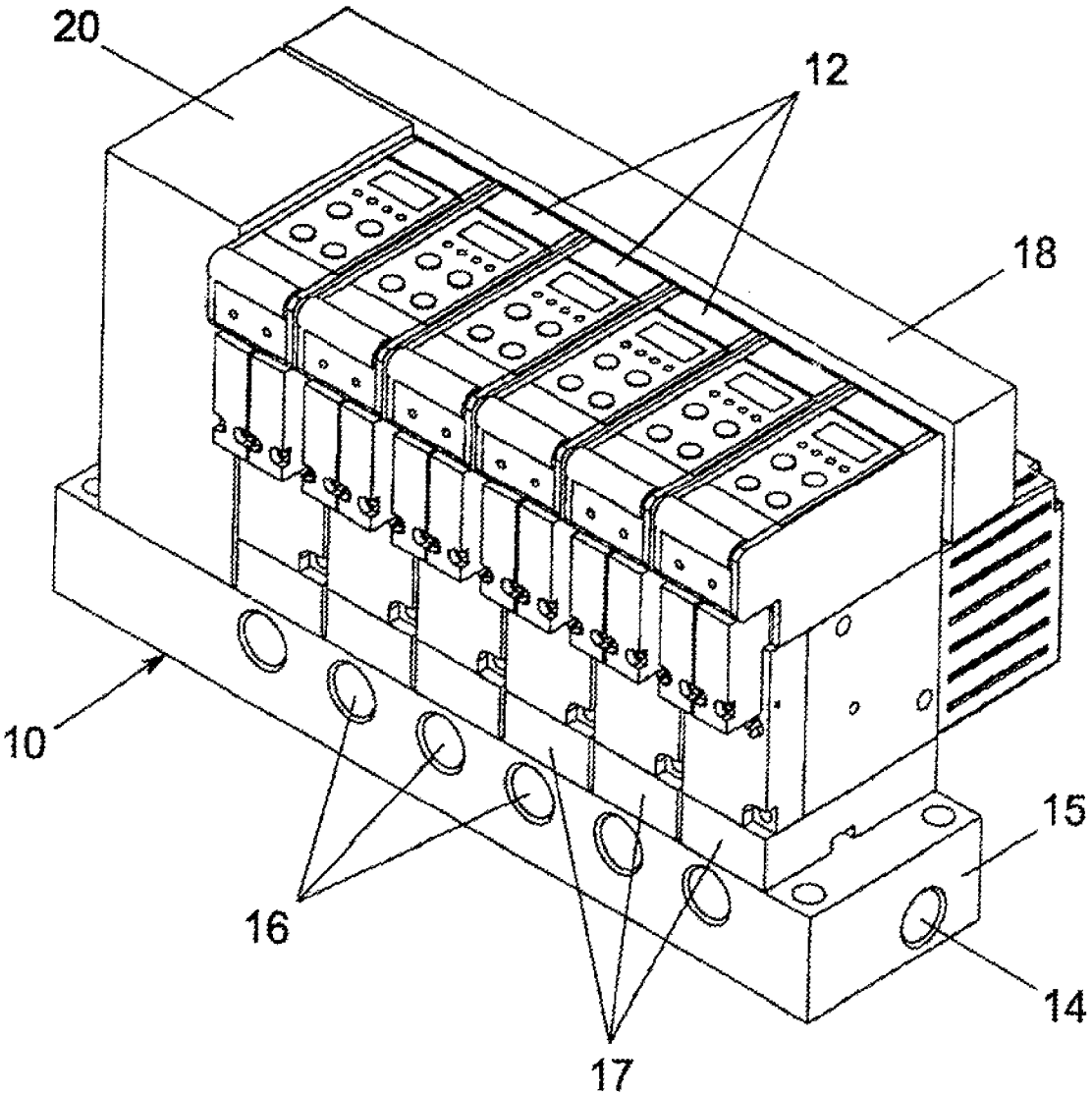
FIG. 1 shows a perspective view of a receiving device with a total of 6 ejectors disposed therein.

FIG. 1 shows a receiving device, designated in total with reference numeral 10, for a total of six ejectors 12, wherein the receiving device has a connection 14 for supplying compressed air, and a total of six connections 16 for connecting suction lines. The connection 14 terminates in a compressed air distribution system 15, to which the ejectors 12 are connected via distributor plates 17, which is described in more detail below. The compressed air distribution system 15 also has channels for the suctioned air which terminate in the connections 16. The receiving device 10 also comprises plug connections for electric contact with the ejectors 12, wherein the plug connections are disposed in an electrical distribution system 18. Control and regulation means and monitoring means, counting means, evaluation means and self-diagnosis means are provided in a housing 20, with which the individual ejectors 12 can be driven or via which the ejectors 12 are regulated. Means may also be provided within the ejectors 12. The receiving device 10 moreover has a fast-exchange system via which the ejectors 12 may be individually removed from and reinserted into the receiving device 10.

Figure 2:
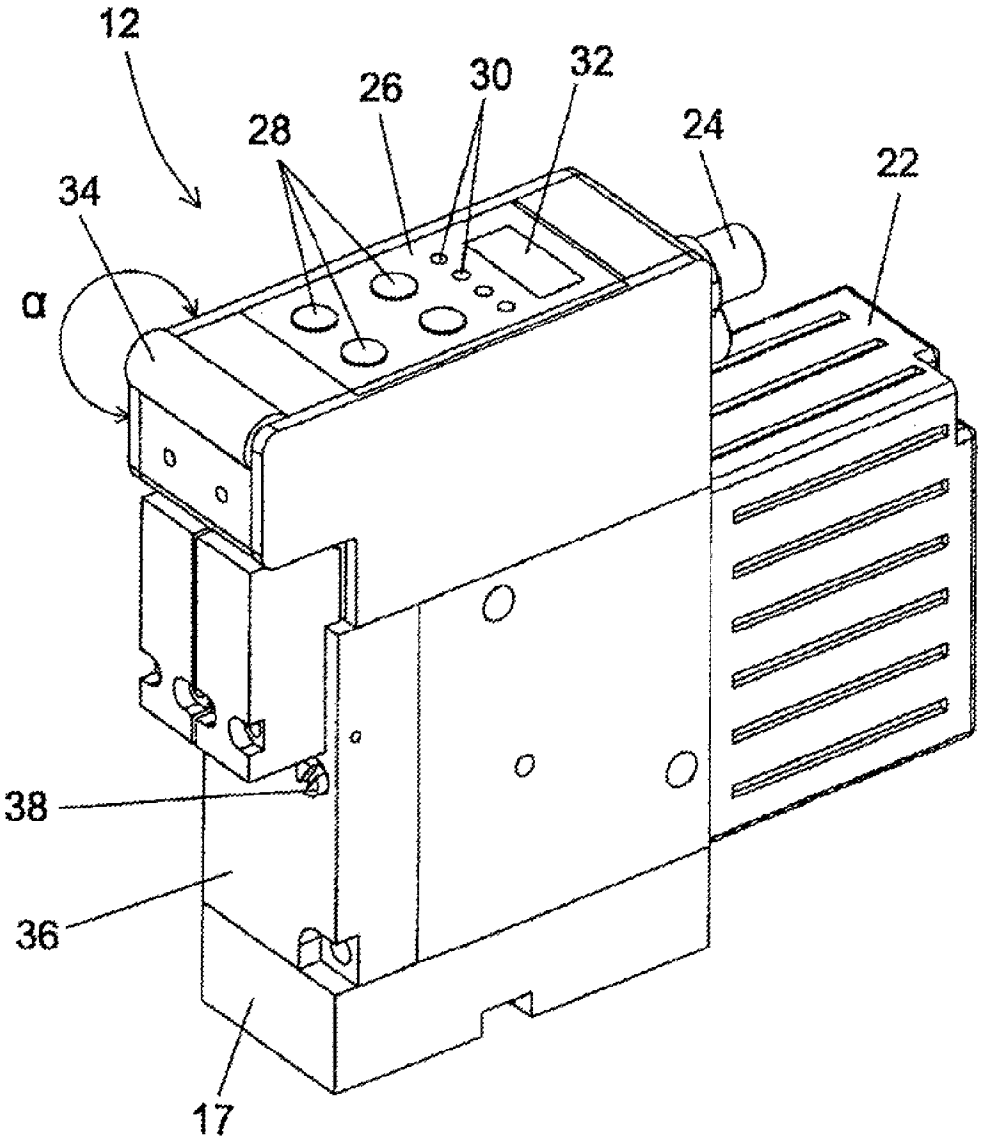
FIG. 2 shows a perspective view of an ejector.

FIG. 2 shows an individual ejector 12 which has on its rear side a sound absorber 22 for the compressed air leaving the ejector 12. The compressed air is transferred into the ejector 12 via a connection provided on the lower side, which feeds into the distributing plate 17. A plug 24 is also shown which can be inserted into the electrical distribution system 18.

The upper side 26 of the ejector 12 has different keys 28, and two displays 32, 30 and 34 are provided. The display 32 is a digital display and the display 30 is e.g. an LED and is used as programming aid. The display 32 can be dimmed and/or switched off as described above. The display 34 is a colored display, in particular, a multi-colored display which projects past the surface of the upper side 26 and is therefore visible from both sides and from the front and top, viewed through an angle $\alpha$ of more than 270°. This display 34 can also be dimmed and/or switched off and changes between the colors red and green.

The ejector 12 moreover has easily accessible adjusting means 38 in the form of adjusting screws at its front side 36 for adjusting the limit values. A throttle may e.g. be adjusted in order to adjust the blow-off flow. Limit values may also be adjusted via the keys 28, wherein the blow-off pressure, suction pressure, suction times, blow-off times, the break between suctioning and blowing off, limit values for the number of operating cycles etc. can be adjusted as the limit value.

Figure 3:
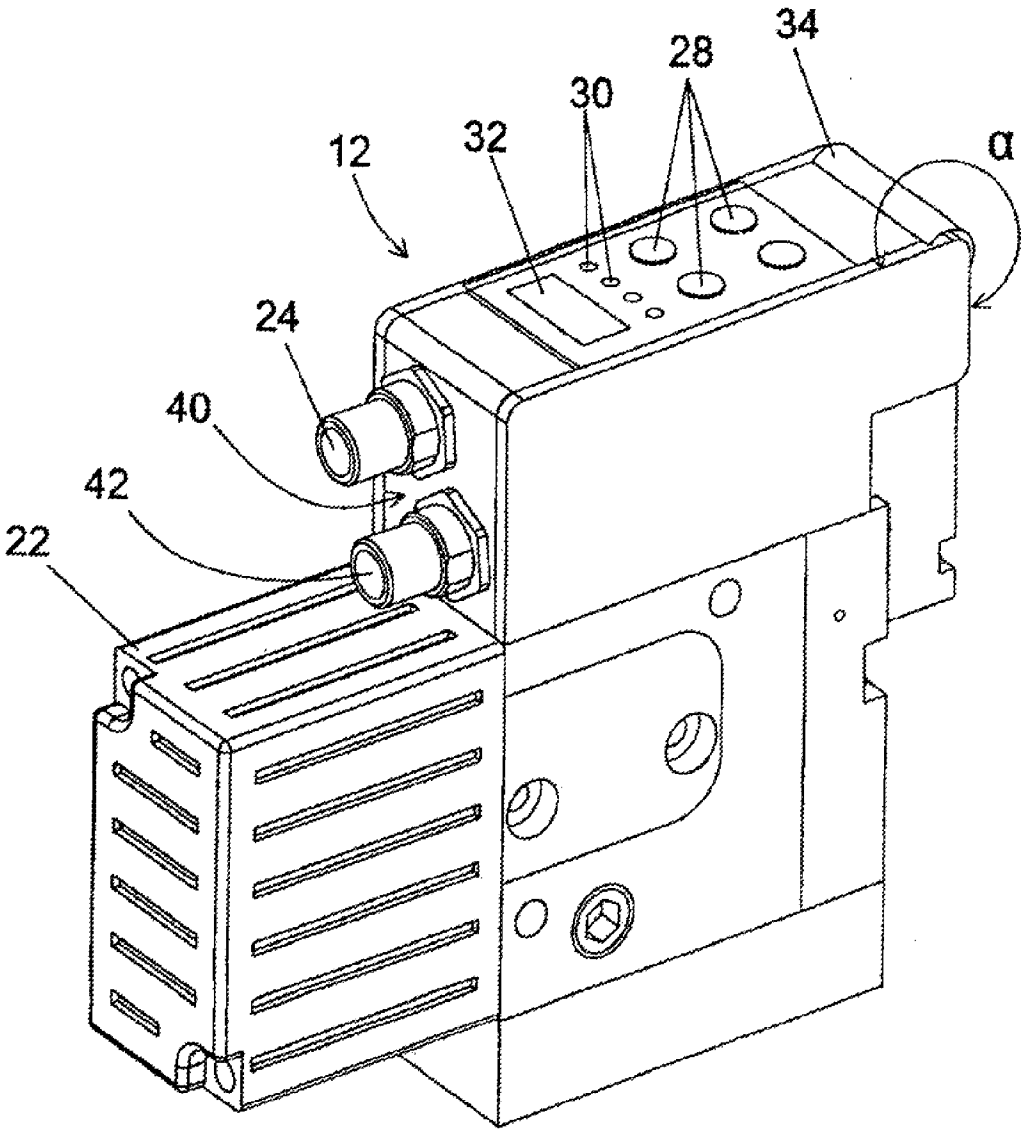
FIG. 3 shows a perspective view of the rear side of an ejector showing a connection to the compressed air channel and a connection to the suction channel.

FIG. 3 shows the rear side 40 of the ejector 12 where the sound absorber 22 is mounted. It shows a further plug 42 in addition to plug 24, which also terminates in the electrical distribution system 18 and transmits data and/or electrical energy.

The narrow shape of the ejector 12 permits tight packing of several ejectors 12 in the receiving device 10 which saves a large amount of tubing.

Moreover, the housing 20 may also be provided with pressure keys 28 and displays 32 and 34 via which the ejectors 12 disposed in the receiving device 10 can be adjusted together or which display data of this ejector 12.

I claim:

1. A device for monitoring loss of negative pressure in a negative pressure generator for suctioning and handling work pieces, the device comprising:

an element for determining a number of suctioned and handled work pieces;

an element for defining a reference number of operating cycles to be equal to the number of suctioned and handled work pieces;

an element for measuring and counting an actual number of operating cycles;

an element for comparing the actual number of operating cycles to the reference value of operating cycles; and an element for determining a degree of negative pressure loss in the negative pressure generator in dependence on a difference between the actual number of operating cycles and the reference number of operating cycles.

2. The device of claim 1, the device further comprising:

at least one ejector having a compressed air channel, a negative pressure system, and a sensor;

a machine control unit;

control lines connecting said ejector to said machine control unit;

means for monitoring the number of control processes; and means for evaluating signals detected by said sensor.

3. The device of claim 2, wherein said ejector has a valve or a bi-stable valve for blocking said compressed air channel.

4. The device of claim 3, wherein said valve is driven by a control means provided in said ejector.

5. The device of claim 3, wherein said valve is driven by said machine control unit.

6. The device of claim 3, wherein said valve is designed as a self-holding valve which maintains an instantaneous position thereof when a voltage drops.

7. The device of claim 2, wherein said monitoring means comprises a control unit for driving or for switching-off regulating means.

8. The device of claim 2, wherein said ejector has a second monitoring means which detects an evacuation time.

9. The device of claim 2, wherein said monitoring means is connected to an error notification system.

10. The device of claim 2, wherein said ejector comprises means for adjusting a priority of an additional control means or of said machine control unit.

11. The device of claim 2, wherein said ejector has a counting device for counting a number of suctioned workpieces, a number of valve position changes, and/or a number of regulation errors.

12. The device of claim 11, wherein said ejector has an evaluation means for said counting device.

13. The device of claim 2, wherein said ejector has a transmission device for transmitting data to said machine control unit.

14. The device of claim 2, wherein said ejector has a memory for detected data.

15. The device of claim 14, wherein said memory is read in a wireless fashion.

16. The device of claim 2, wherein said ejector has a self-diagnosis means.

17. The device of claim 16, wherein said self-diagnosis means comprises a measuring means for a time behavior and/or an absolute value of negative pressure.

18. The device of claim 2, wherein said ejector has a display which automatically changes into a dimmed state or sleep mode after a predetermined time.

19. The device of claim 18, wherein said display can be switched manually and/or by said machine control unit and/or comes on in case of an error message.

20. The device of claim 18, wherein said display is multicolored and changes color in response to an error message.

21. The device of claim 2, wherein adjustment parameters of said ejector can be adjusted via keys, said machine control unit, or in a wireless fashion.

22. The device of claim 2, wherein a reset is effected via said machine control unit, as an ejector, or in a wireless fashion.

23. A quick-connect system for the ejector of claim 2, wherein said receiving device is connected to ejectors via control lines and is connected to said machine control unit.

24. A method for monitoring loss of negative pressure in a device generating negative pressure for suctioning and handling work pieces, the method comprising the steps of:

a) determining a number of suctioned and handled work pieces;

b) defining a reference number of operating cycles to be equal to the number of suctioned and handled work pieces;

c) measuring and counting an actual number of operating cycles;

d) comparing the actual number of operating cycles to the reference value of operating cycles; and e) determining a degree of negative pressure loss in the device in dependence on a difference between the actual number of operating cycles and the reference number of operating cycles.

* * * * *